US011150016B2

(12) United States Patent
Hirose et al.

(10) Patent No.: US 11,150,016 B2
(45) Date of Patent: Oct. 19, 2021

(54) NITROGEN PRODUCTION SYSTEM FOR PRODUCING NITROGEN WITH DIFFERENT PURITIES AND NITROGEN PRODUCTION PROCESS THEREOF

(71) Applicant: L'Air Liquide, Societe Anonyme pour l'Etude et l'Exploitation des Procedes Georges Claude, Paris (FR)

(72) Inventors: Kenji Hirose, Hyogo (JP); Hirofumi Utsunomiya, Hyogo (JP); Daisuke Nagata, Hyogo (JP); Yasuharu Nishi, Hyogo (JP); Shinji Tomita, Hyogo (JP)

(73) Assignee: L'Air Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 338 days.

(21) Appl. No.: 15/956,921

(22) Filed: Apr. 19, 2018

(65) Prior Publication Data

US 2018/0306497 A1 Oct. 25, 2018

(30) Foreign Application Priority Data

Apr. 19, 2017 (JP) ..... 2017-83203

(51) Int. Cl.
*F25J 3/04* (2006.01)

(52) U.S. Cl.
CPC ..... *F25J 3/04309* (2013.01); *F25J 3/044* (2013.01); *F25J 3/04018* (2013.01); (Continued)

(58) Field of Classification Search
CPC ..... F25J 3/04309; F25J 3/04018; F25J 3/04187; F25J 3/044; F25J 3/04296; (Continued)

(56) References Cited

U.S. PATENT DOCUMENTS 5,170,630 A * 12/1992 Stern ..... F25J 3/04048 62/643
5,385,024 A * 1/1995 Roberts ..... F25J 3/04048 62/647

(Continued)

FOREIGN PATENT DOCUMENTS

| | | |
|---|---|---|
| JP | 60-147086 | 8/1985 |
| JP | 61-171523 | 8/1986 |
| JP | 03-186183 | 8/1991 |
| JP | 06-207775 | 7/1994 |
| JP | 09-217982 | 8/1997 |

*Primary Examiner* — Joseph F Trpisovsky
(74) *Attorney, Agent, or Firm* — Justin K. Murray

(57) ABSTRACT

A nitrogen production system that can produce high purity nitrogen containing a desired concentration of oxygen and ultrahigh purity nitrogen containing a desired concentration of argon in a single rectifying column while restraining increase in electric power consumption and a production process thereof are provided. The method can include the steps of rectifying a cooled and compressed air stream in the rectifying column; withdrawing the ultrahigh purity nitrogen stream from a top portion of the nitrogen rectifying column, warming the ultrahigh purity nitrogen stream in a heat exchanger, and then recovering the ultrahigh purity nitrogen stream from the heat exchanger; and withdrawing a high purity nitrogen stream from a rectification section of the nitrogen rectifying column, warming the high purity nitrogen stream in the heat exchanger, and then recovering the high purity nitrogen stream from the heat exchanger.

13 Claims, 4 Drawing Sheets

(52) U.S. Cl.
CPC ..... *F25J 3/0426* (2013.01); *F25J 3/04187* (2013.01); *F25J 3/04284* (2013.01); *F25J 3/04296* (2013.01); *F25J 3/04769* (2013.01); *F25J 2210/42* (2013.01); *F25J 2215/42* (2013.01); *F25J 2215/44* (2013.01); *F25J 2220/50* (2013.01); *F25J 2230/40* (2013.01)

(58) Field of Classification Search
CPC ..... F25J 2220/50; F25J 2215/42; F25J 2215/44; F25J 2230/40; F25J 2210/42; F25J 3/0426; F25J 3/04284; F25J 3/04769; F25J 3/04109; F25J 3/04345; F25J 3/04775; F25J 3/048
USPC ..... 62/656
See application file for complete search history.

(56) References Cited

U.S. PATENT DOCUMENTS

| | | | | | |
|---|---|---|---|---|---|
| 5,711,167 | A * | 1/1998 | Ha | F25J 3/04048 | 62/652 |
| 5,906,113 | A * | 5/1999 | Lynch | F25J 3/0426 | 62/646 |
| 6,279,345 | B1 * | 8/2001 | Arman | F25J 3/04048 | 62/647 |
| 8,443,625 | B2 * | 5/2013 | Prosser | F25J 3/04721 | 62/644 |
| 2005/0072187 | A1 * | 4/2005 | Seiver | F25J 3/04254 | 62/643 |

* cited by examiner

| | | | | | | | | | | | |
|---|---|---|---|---|---|---|---|---|---|---|---|
| EXAMPLE | NTP IN COLUMN TOP | 60 | 60 | 60 | 60 | 60 | 60 | 60 | 60 | 60 | 60 |
| | NTP IN INTERMEDIATE PLATE | 49 | 48 | 47 | 46 | 45 | 44 | 43 | 42 | 41 | 40 |
| | MATERIAL AIR AMOUNT ($Nm^3/h$) | 1000 | 1000 | 1000 | 1000 | 1000 | 1000 | 1000 | 1000 | 1000 | 1000 |
| | DERIVED AMOUNT OF ULTRAHIGH PURITY NITROGEN OF ARGON CONCENTRATION OF 1 VOLUME ppm DERIVED FROM COLUMN TOP ($Nm^3/h$) | 9 | 57 | 100 | 139 | 175 | 208 | 239 | 267 | 293 | 318 |
| | DERIVED AMOUNT OF HIGH PURITY NITROGEN OF OXYGEN CONCENTRATION OF 1 VOLUME ppm DERIVED FROM COLUMN INTERMEDIATE ($Nm^3/h$) | 398 | 347 | 302 | 259 | 220 | 184 | 149 | 117 | 85 | 55 |
| Comparative Example: COLUMN TOP PART COMPARISON | NTP DERIVING NITROGEN | 60 | 60 | 60 | 60 | 60 | 60 | 60 | 60 | 60 | 60 |
| | DERIVED AMOUNT OF ULTRAHIGH PURITY NITROGEN OF ARGON CONCENTRATION OF 1 VOLUME ppm TO 1000Nm3/h OF MATERIAL AIR ($Nm^3/h$) | 363 | 363 | 363 | 363 | 363 | 363 | 363 | 363 | 363 | 363 |
| Comparative Example: COLUMN INTERMEDIATE PART COMPARISON | NTP DERIVING NITROGEN | 49 | 48 | 47 | 46 | 45 | 44 | 43 | 42 | 41 | 40 |
| | DERIVED AMOUNT OF HIGH PURITY NITROGEN OF OXYGEN CONCENTRATION OF 1 VOLUME ppm TO 1000Nm3/h OF MATERIAL AIR ($Nm^3/h$) | 407 | 405 | 403 | 401 | 399 | 395 | 392 | 389 | 385 | 381 |
| RESULT | MATERIAL AIR AMOUNT FOR ACHIEVING ULTRAHIGH PURITY AND HIGH PURITY NITROGEN DERIVED AMOUNTS IN EXAMPLE, IN COMPARATIVE EXAMPLE ($Nm^3/h$) | 1002.7 | 1013.8 | 1024.9 | 1028.8 | 1033.5 | 1036.8 | 1038.5 | 1036.3 | 1027.9 | 1020.4 |
| | MATERIAL AIR INTAKE IMPROVEMENT RATE | 0.30% | 1.40% | 2.50% | 2.90% | 3.30% | 3.88% | 3.85% | 3.60% | 2.80% | 2.00% |

FIG. 3

| | NTP RECOVERING NITROGEN | MATERIAL AIR AMOUNT ($Nm^3/h$) | ULTRAHIGH PURITY NITROGEN RECOVERY AMOUNT ($Nm^3/h$) | HIGH PURITY NITROGEN RECOVERY AMOUNT ($Nm^3/h$) | TOTAL NITROGEN RECOVERY AMOUNT ($Nm^3/h$) | TOTAL NITROGEN RECOVERY AMOUNT INCREASE RATE ACCORDING TO EXAMPLE CE 1=(392-314)/314 CE 2=(392-363)/363 |
|---|---|---|---|---|---|---|
| EXAMPLE | 44 | 1000 | – | 184 | 392 =(208+184) | |
| | 60 | | 208 | – | | |
| COMPARATIVE EXAMPLE 1(CE1) | 44 | 1000 | 314 | – | 314 | 25% |
| COMPARATIVE EXAMPLE 2(CE2) | 60 | 1000 | 363 | – | 363 | 8% |

FIG. 4

NITROGEN PRODUCTION SYSTEM FOR PRODUCING NITROGEN WITH DIFFERENT PURITIES AND NITROGEN PRODUCTION PROCESS THEREOF

CROSS REFERENCE TO RELATED APPLICATIONS

This application claims the benefit of priority under 35 U.S.C. § 119 (a) and (b) to Japanese patent application No. JP2017-83203, filed Apr. 19, 2017, the entire contents of which are incorporated herein by reference.

BACKGROUND OF THE INVENTION

Field of the Invention

The present invention relates to a nitrogen production apparatus for producing nitrogen with different purities and a production process thereof, and particularly to an apparatus and a process for producing ultrahigh purity nitrogen gas with a low argon (hereinafter, also referred to as Ar) content and nitrogen gas having a predetermined concentration of oxygen content in a single rectifying column.

Description of the Related Art

Conventionally, material air that is cooled in a heat exchanger has been introduced into a lower part of a nitrogen rectifying column, and has been rectified, from which nitrogen has been separated to a column top, and liquid air having a high oxygen (hereinafter, also referred to as O2) content has been separated to a lower part respectively, and a part of the separated nitrogen has been extracted as a product gas (for example, U.S. Pat. No. 5,711,167).

SUMMARY OF THE INVENTION

Impurities that are expected to be separated in rectification of nitrogen are generally oxygen components, but in recent years, separation of argon has been especially expected in some applications such as the semiconductor field. That is, providing both ultrahigh purity nitrogen having a low argon content, and high purity nitrogen with a lower purity than the ultrahigh purity nitrogen is required. However, since argon is chemically inert, it is difficult to remove argon by a chemical process such as an adsorption process. Further, argon has a smaller boiling point difference from nitrogen as compared with oxygen, so that separation of argon by rectification causes reduction in recovery percentage of nitrogen. Reduction in recovery percentage has a problem of involving increase in electric power consumption accompanying increase in a necessary material air amount.

For example, in the apparatus in U.S. Pat. No. 5,711,167 described above, in order to produce oxygen with a low argon content, it is necessary to increase the theoretical plate number of the rectifying unit of the rectifying column. However, in general, the height of the nitrogen rectifying column is very high (for example, 50 m), and increasing the theoretical plate number results in extension of the rectifying column, which is not realistic industrially.

Further, in the semiconductor field and the like in which separation of Ar is required, continuous measurement of a concentration of argon in nitrogen is also required. However, continuous measurement of the concentration of argon in nitrogen is difficult in general. This is because chemical/physical properties of nitrogen and Ar closely resemble each other. Therefore, a discontinuous analytical method such as gas chromatography has been conventionally used in measurement of Ar in nitrogen. The Ar content is very small in ultrahigh purity nitrogen, and measurement is especially difficult irrespective of whether continuous measurement or discontinuous measurement is used.

In the light of the aforementioned circumstances, an object of the present invention is to provide a nitrogen production system that can produce high purity nitrogen containing a desired concentration of oxygen and ultrahigh purity nitrogen containing a desired concentration of argon in a single rectifying column while removing the above described disadvantage and suppressing increase in electric power consumption, and a production process thereof. Further, the present invention provides a nitrogen production system that can precisely control a production amount of ultrahigh purity nitrogen and an argon concentration thereof by continuously measuring oxygen in high purity nitrogen, and a nitrogen production process thereof.

The inventors calculated the concentrations (volume ppm) of oxygen and Ar in a gas phase in respective theoretical plate numbers (NTP 1 to 60) of the rectifying unit in a nitrogen rectifying column and found the result as follows. The result is illustrated in FIG. 1.

As is obvious from gradients of respective plots of oxygen and argon in Table 1, argon is more difficult to separate from nitrogen as compared with oxygen, and more argon is present in the gas phase than oxygen in the theoretical plate number (NTP) 19 or more, though the concentration of argon (approximately 0.9%) in the material air is lower than the concentration of oxygen (approximately 21.0%).

This means that when argon needs to be separated from nitrogen, separation of oxygen is likely to be excessively performed, and, for example, when a concentration of 1 ppm of each of oxygen and argon is required, in order to make the concentration of argon 1 volume ppm, the oxygen concentration resultantly becomes approximately 0.001 volume ppm, which is much smaller than the required oxygen concentration, and means that excessively large energy is inputted to separate oxygen.

Further, a demand for nitrogen containing no argon is only a part of the entire semiconductor production process, such as plasma CVD, for example, so that high-degree argon removal does not have to be applied to every nitrogen produced by a nitrogen generating apparatus.

Consequently, it is considered to be thermodynamically efficient and resultantly contribute to electric power saving of the nitrogen generating apparatus to separately recover nitrogen having a plurality of purities (for example, ultrahigh purity nitrogen controlled with 1 volume ppm of argon, and nitrogen controlled with 1 volume ppm of oxygen (argon concentration is 45 volume ppm)) from the rectifying column in accordance with applications of nitrogen.

As a result of the above described experiment and investigation described above, the present inventors found that high purity nitrogen containing a desired concentration of oxygen and ultrahigh purity nitrogen containing a desired concentration of argon can be produced in a single rectifying column by recovering high purity nitrogen containing a desired concentration of oxygen (an argon content is a predetermined value or more) from an intermediate plate of the rectifying unit of the nitrogen rectifying column. Further, the present inventors found that recovery amounts of high purity nitrogen and ultrahigh purity nitrogen can be controlled, and contribution can be made to electric power saving.

A nitrogen production system in accordance with an embodiment of the present invention can include: a compressor that compresses material air, a removal unit that removes predetermined impurities from the material air compressed by the compressor, a heat exchanger that cools the material air from which the impurities are removed by the removal unit, a nitrogen rectifying column including a rectifying unit into which the material air cooled by the heat exchanger is introduced, and a condenser (also referred to as a condensing device) that is located at a column top, a first introduction pipe that introduces the compressed material air from the heat exchanger into a buffer unit located at a lower part from a position of the rectifying unit of the nitrogen rectifying column, a second introduction pipe for introducing an oxygen-enriched liquefied gas into the condenser from the buffer unit of the nitrogen rectifying column, a first derivation pipe for deriving ultrahigh purity nitrogen containing a first concentration of argon, from an upper plate or an uppermost plate of the rectifying unit of the nitrogen rectifying column, and recovering the ultrahigh purity nitrogen through the heat exchanger, and a second derivation pipe for deriving high purity nitrogen containing a second concentration of oxygen from an intermediate plate of the rectifying unit of the nitrogen rectifying column, and recovering the high purity nitrogen through the heat exchanger.

The oxygen-enriched liquefied gas may contain oxygen gas generated in the rectifying unit and the material air.

The ultrahigh purity nitrogen that is derived by the first derivation pipe may be in a gaseous state or a liquid state.

The high purity nitrogen that is derived by the second derivation pipe may be in a gaseous state or a liquid state.

In the case of ultrahigh purity nitrogen in a gaseous state, heat exchange may be performed by the first derivation pipe passing through the heat exchanger.

In the case of high purity nitrogen in a gaseous state, heat exchange may be performed by the second derivation pipe passing through the heat exchanger.

In the present invention, the rectifying unit is not specially limited, and can be a known rectifying column, for example, may be a rectifying unit of a type in which a filler is filled, or may be a rectifying unit of a type in which trays are disposed. When the rectifying unit is of a filler type, the rectifying unit may a filled structure filled with a regular filler or an irregular filler, or may further include a distributor in an upper part of the filled structure. The rectifying unit may be equipped with a plurality of the filled structures.

Means (process) for extracting the ultrahigh purity nitrogen is extraction from the upper part of the rectifying unit, and may be, for example, a suction structure provided at a tip end of the first derivation pipe.

Means (process) for extracting the high purity nitrogen is extraction from an intermediate plate of the rectifying unit, and may be, for example, a suction structure provided at a tip end of the second derivation pipe.

In the present invention, upper plates, intermediate plates and lower plates of the rectifying unit may be in the ratio of, for example, 1:1:1, or 1:1 to 10:1 in a height of the entire rectifying unit. In the total number of a plurality of filled structures configuring the rectifying unit, a ratio of the number of upper plates:the number of intermediate plates: the number of lower plates may be, for example, a ratio of 1:1:1, or 1:1 to 10:1. In order to extract high purity nitrogen gas of a desired purity, any one position is set among the intermediate plates, and the second derivation pipe is connected thereto.

In certain embodiments of the present invention, the impurities are, for example, water and carbon dioxide.

In certain embodiments of the present invention, the first concentration of the argon is 0.001 ppm to 100 ppm inclusive, and preferably can be set at 0.1 volume ppm to 10 volume ppm inclusive.

In certain embodiments of the present invention, the second concentration of the oxygen is, for example, 0.001 ppm to 1000 ppm inclusive.

In certain embodiments of the present invention, the concentration of argon contained in the high purity nitrogen is higher than the first concentration that is the concentration of argon contained in the ultrahigh purity nitrogen.

When the first concentration is in a concentration range of 0.001 volume ppm to 100 volume ppm inclusive, high purity nitrogen having an Ar content of the first concentration or more can be used for general semiconductor processes and industrial gas.

Ultrahigh purity nitrogen in the case of the first concentration being in a concentration range of 0.1 volume ppm to 10 volume ppm inclusive can be used in a process of plasma CVD or the like in which highly purified gas is required in the semiconductor processes. In the ultrahigh purity nitrogen like this, an increase or decrease width of the concentration of impurities (including Ar) in nitrogen is very small, so that the ultrahigh purity nitrogen is useful for improving yield of a plasma process.

In order to produce nitrogen with a plurality of purities, a plurality of nitrogen rectifying columns designed in accordance with the respective purities have been conventionally required. In contrast, according to the present invention, nitrogen with a plurality of purities can be produced simultaneously in the single nitrogen rectifying column.

As compared with the case of producing nitrogen with a plurality of purities by separate nitrogen rectifying columns, the necessary amount of material air is small. Reduction in the material air amount leads to reduction in consumption of electric power required to compress the material air, and electric power necessary for removal of water and carbon dioxide before introducing the material air into the heat exchanger. Further, reduction in the material air leads to enhancement in the recovery percentage of nitrogen. Further, as compared with the case of installing a plurality of production apparatuses, a smaller number of devices and pipes are used, and an installation area is also small.

The single high purity nitrogen extraction pipe may be installed, but a plurality of high purity nitrogen extraction pipes also can be installed.

When the single high purity nitrogen extraction pipe is installed, nitrogen with two kinds of purities, that is, ultrahigh purity nitrogen and high purity nitrogen can be obtained.

When two or more of the high purity nitrogen extraction pipes are installed in positions corresponding to different plate numbers out of the intermediate plates of the rectifying unit, nitrogen of three or more purities in total, that is, ultrahigh purity nitrogen and two or more kinds of high purity nitrogen, can be obtained.

Ar contents in high purity nitrogen and ultrahigh purity nitrogen are determined by the position (that is, the plate number of the rectifying unit) of the high purity nitrogen extraction pipe, and the extraction amounts of high purity nitrogen and ultrahigh purity nitrogen to the amount of the material air that is taken in. Thus, the high purity nitrogen extraction pipe is disposed at the position corresponding to a desired Ar content. The material air intake amount and the extraction amount of high purity nitrogen are set at fixed amounts that are specified in advance. The extraction amount of ultrahigh purity nitrogen is set in accordance with the desired content of argon and the intake amount of the material air. Thereby, a fixed extraction amount of high purity nitrogen and a fixed extraction amount of ultrahigh purity nitrogen (the argon content is a desired amount or less) can be produced in the single rectifying column.

In the above described invention, an oxygen concentration measurement unit that measures an oxygen concentration in the high purity nitrogen in the second derivation pipe downstream of the heat exchanger, and a flow rate control unit that controls a first flow rate adjustment unit provided in the first derivation pipe downstream of the heat exchanger, based on the oxygen concentration measured by the oxygen concentration measurement unit may be included.

In the above described invention, a second flow rate adjustment unit provided in the second derivation pipe downstream of the heat exchanger may be further included. The second flow rate adjustment unit may control an extraction amount of the high purity nitrogen so as to achieve a desired flow rate specified in advance.

The first flow rate adjustment unit may control an extraction amount of the ultrahigh purity nitrogen so as to achieve a desired flow rate specified in advance.

The oxygen concentration measurement unit may measure the oxygen concentration in real time, or may measure the oxygen concentration in a predetermined timing or in accordance with a measurement rule set in advance.

The flow rate control may control the first flow rate adjustment unit so that the oxygen concentration keeps a target value (or a predetermined range).

The flow rate control unit, for example, may control the first flow rate adjustment unit so as to increase the flow rate of the ultrahigh purity nitrogen when the oxygen concentration decreases below a target value (or a predetermined range), and control the first flow rate adjustment unit so as to decrease the flow rate of the ultrahigh purity nitrogen when the oxygen concentration increases more than the target value (or the predetermined range).

The Ar concentration in high purity nitrogen and the $O_2$ concentration in ultrahigh purity nitrogen are correlated, so that the $O_2$ concentration in the high purity nitrogen, which is obtained when the Ar concentration in the ultrahigh purity nitrogen is a desired concentration can be obtained in advance. Accordingly, by controlling the $O_2$ concentration, the Ar concentration can be controlled to the target concentration with high precision.

In the present invention, the condenser may be further provided with a third introduction pipe that introduces liquid nitrogen for cooling as a cold heat source of the condenser.

According to the above described configuration, in order to cool and liquefy the gas rising in the rectifying unit with the condenser at the column top to cause the liquefied gas to flow back to the rectifying unit, liquid nitrogen that cools the condenser at the column top is introduced from outside.

In the present invention, a waste gas introduction pipe that introduces waste gas extracted from the condenser (or a space for waste gas storage in the column top) into the heat exchanger via an expansion turbine may be further provided.

According to the above described configuration, waste gas containing a lot of low-boiling point impurities is separated in the condenser upper part, and the waste gas is introduced into the heat exchanger as the heat medium through the waste gas introduction pipe and the expansion turbine, exchanges heat with the material air, and thereafter is discharged. The waste gas is introduced into the expansion turbine, has the temperature reduced by expanding in the expansion turbine, and is introduced into the heat exchanger. The waste gas the temperature of which is reduced exchanges heat with the material air in the heat exchanger, and the cooled material air is introduced into the rectifying unit, so that the expansion turbine plays a role of keeping cold heat balance of nitrogen separation.

Another aspect of the present invention is a nitrogen production process of producing nitrogen by low temperature distillation, including a compression step of compressing material air, a removal step of removing predetermined impurities from the material air compressed in the compression step, a cooling step of cooling the material air from which the impurities are removed in the removal step by a heat exchanger, a first introduction step of introducing the material air cooled by the heat exchanger into a lower part from the rectifying unit position of a nitrogen rectifying column including a rectifying unit and a condenser located in a column top, a second introduction step of introducing an oxygen-enriched liquefied gas into the condenser from the lower part from the rectifying unit position of the nitrogen rectifying column, a first derivation step of deriving ultrahigh purity nitrogen containing a first concentration of argon from an upper plate or an uppermost plate of the rectifying unit of the nitrogen rectifying column, and recovering the ultrahigh purity nitrogen through the heat exchanger, and a second derivation step of deriving high purity nitrogen containing a second concentration of oxygen from an intermediate plate of the rectifying unit of the nitrogen rectifying column, and recovering the high purity nitrogen through the heat exchanger.

In the above described invention, an oxygen concentration measuring step of measuring an oxygen concentration in the high purity nitrogen downstream of the heat exchanger, and a flow rate control step of controlling a first flow rate adjustment unit that is provided downstream of the heat exchanger and adjusts a flow rate of ultrahigh purity nitrogen, based on the oxygen concentration measured in the oxygen concentration measuring step may be further included.

In the above described invention, a control step of controlling the extraction amount of the high purity nitrogen by the second flow rate adjustment unit that is provided downstream of the heat exchanger and adjusts the flow rate of high purity nitrogen may be further included.

The oxygen concentration measuring step may measure the oxygen concentration in real time, or measure the oxygen concentration in a predetermined timing or in accordance with a measurement rule set in advance.

The flow rate control step may control the first flow rate adjustment unit so that the oxygen concentration keeps a target value (or a predetermined range).

The flow rate control step, for example, may control the first flow rate adjustment unit so as to increase the flow rate of the ultrahigh purity nitrogen when the oxygen concentration decreases below a target value (or a predetermined range), and control the first flow rate adjustment unit so as to decrease the flow rate of the ultrahigh purity nitrogen when the oxygen concentration increases more than the target value (or the predetermined range).

In the present invention, a step of cooling the condenser by introducing liquid nitrogen into the condenser can be further included.

The present invention may also have a step of introducing waste gas extracted from the condenser into the heat exchanger through an expansion turbine, and performing heat exchange between the waste gas and the material air.

BRIEF DESCRIPTION OF THE DRAWINGS

FIG. 3 is a diagram illustrating a simulation result in the nitrogen rectifying column; and FIG. 4 is a diagram illustrating total nitrogen recovery amounts based on the simulation result in FIG. 3.

DETAILED DESCRIPTION OF THE PREFERRED EMBODIMENTS

Figure 1:
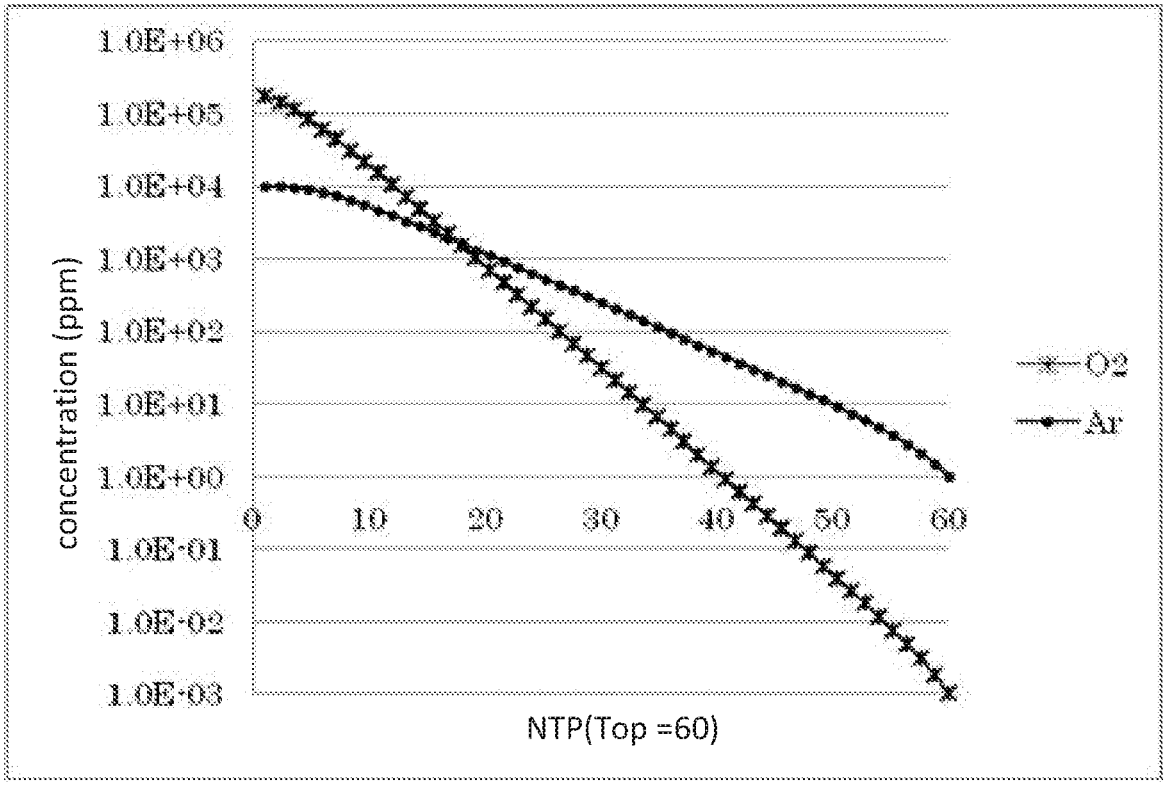
FIG. 1 is a diagram illustrating concentrations of oxygen and Ar in a gas phase in respective theoretical plate numbers of a rectifying unit in a nitrogen rectifying column.

Hereinafter, several embodiments of the present invention will be described. The embodiments described as follows describe one example of the present invention. The present invention is not limited to the following embodiments in any way, and also includes various modified modes that are carried out in a range without changing the gist of the present invention. All of components described as follows are not always essential components of the present invention.

Embodiment 1

A nitrogen production system 1 of embodiment 1 will be described with use of FIG. 2. The nitrogen production system 1 has a heat exchanger H, a nitrogen rectifying column including a rectifying unit A and a condenser C located in a column top, a material air intake pipe 2 for feeding material air to cool the material air in the heat exchanger H, a material air introduction pipe 3 for feeding the cooled material air to the rectifying unit A, an oxygen-enriched liquefied gas introduction pipe 4 that derives an oxygen-enriched liquefied gas from the lower part of the rectifying unit A and introduces the oxygen-enriched liquefied gas into the condenser C to cool an inside of the condenser C, an ultrahigh purity nitrogen extraction pipe 5 that derives ultrahigh purity nitrogen from an upper plate of the rectifying unit A and introduces the ultrahigh purity nitrogen into the heat exchanger H, and a high purity nitrogen extraction pipe 6 that derives high purity nitrogen from an intermediate plate of the rectifying unit A and introduces the high purity nitrogen into the heat exchanger H. The respective components will be described in detail hereinafter.

The heat exchanger H cools the material air (for example, a material air amount is 1000 $Nm^3/h$) that is compressed by a compressor (not illustrated), and has impurities such as carbon dioxide and water removed in a purification unit (corresponding to an impurity removal unit, not illustrated). The introduced material air exchanges heat with high purity nitrogen described later and ultrahigh purity nitrogen that will be described later in the heat exchanger H to be cooled to a vicinity of a liquefaction point. The cooled material air is in a state of a liquefied gas and is introduced into the rectifying unit A by the material air introduction pipe 3.

The material air in the liquefied gas state which is introduced into the rectifying unit A rises in the rectifying unit A and is rectified. A range of an operation pressure of the rectifying unit A is 5 barA to 20 barA, and the operation pressure can be set at 9 bar, for example. Further, the number of theoretical plates of the rectifying unit A is 40 to 100, and can be set at 60, for example. In a lower part of the rectifying unit A, oxygen-enriched liquefied gas is separated, whereas in an upper part of the rectifying unit A, high purity nitrogen gas is separated. At least part of the oxygen-enriched liquefied gas is derived from the lower part of the rectifying unit A, and is introduced into the condenser C through the oxygen-enriched liquefied gas introduction pipe 4, whereby the condenser is cooled.

From the upper plate of the rectifying unit A, ultrahigh purity nitrogen is derived. Here, high purity nitrogen is derived from an intermediate plate of the rectifying unit A through the high purity nitrogen extraction pipe 6. In the rectifying unit A, a reflux to lower plates from upper plates is performed, and by deriving high purity nitrogen from an intermediate plate, a reflux ratio among intermediate plates and upper plates can be made higher than in the case without performing the reflux. Thereby, as compared with the case where high purity nitrogen is not derived from the intermediate plate, an Ar content in nitrogen that is derived from the upper plate decreases, ultrahigh purity nitrogen with an extremely low Ar content can be extracted, and high purity nitrogen with an oxygen concentration that satisfies the product specifications although having a higher Ar content than the Ar content of ultrahigh purity nitrogen can be obtained from the intermediate plate.

In an upper part of the condenser C, waste gas including a lot of low boiling point impurities is separated. The waste gas passes through a waste gas introduction pipe 7, is introduced into the heat exchanger H to be fed to an expansion turbine T, is thereafter introduced into the heat exchanger H again through a waste gas pipe 8. The waste gas introduced into the expansion turbine T is expanded in the expansion turbine T and thereby a temperature of the waste gas is reduced. The waste gas which is introduced into the heat exchanger H again exchanges heat with the material air in the heat exchanger H, and thereafter is discharged.

The ultrahigh purity nitrogen which is derived from the rectifying unit A is introduced into the heat exchanger H through the ultrahigh purity nitrogen extraction pipe 5, exchanges heat with the material air in the heat exchanger H and rises in temperature, and is provided to a use point in a subsequent stage, or fed to a storage tank. The high purity nitrogen derived from the rectifying unit A is introduced into the heat exchanger H through the high purity nitrogen extraction pipe 6, exchanges heat with the material air and rises in temperature in the heat exchanger H, is provided to a use point in a subsequent stage or fed to a storage tank.

The oxygen content in high purity nitrogen and the Ar content in ultrahigh purity nitrogen are determined by a position of the high purity nitrogen extraction pipe (that is, the plate number of the rectifying unit A), and extraction amounts of high purity nitrogen and ultrahigh purity nitrogen to the amount of the material air which is taken in. Therefore, the high purity nitrogen extraction pipe is disposed in the position corresponding to the desired Ar content in advance.

For example, when the number of theoretical plates of the rectifying unit A is 60, the ultrahigh purity nitrogen extraction pipe 5 is located at a position corresponding to the $60^{th}$ plate, and the high purity nitrogen extraction pipe 6 can be provided at the intermediate plate (a position corresponding to among the $40^{th}$ to $49^{th}$ plates, for example).

The material air intake amount and the high purity nitrogen extraction amount are respectively set at desired flow rates. Further, the extraction amount of ultrahigh purity nitrogen is set in accordance with the desired argon content in the ultrahigh purity nitrogen. Thereby, a fixed extraction amount of high purity nitrogen and a fixed extraction amount of ultrahigh purity nitrogen (containing a desired amount of Ar) can be produced in a single rectifying unit.

The Ar content in the ultrahigh purity nitrogen that is extracted from the upper plate of the rectifying unit A by the ultrahigh purity nitrogen extraction pipe 5 can be also set at less than a first concentration specified in advance, and the Ar content in the high purity nitrogen that is extracted from the intermediate plate of the rectifying unit A by the high purity nitrogen extraction pipe 6 can be also set at the first concentration or more.

The first concentration is 0.001 ppm to 100 ppm inclusive, and is preferably 0.1 volume ppm to 10 volume ppm inclusive. The first concentration can be determined in consideration of the requirement or the like of the application in which nitrogen to be a product is used, and can be set at, for example, 1 volume ppm or 100 weight ppb.

The nitrogen production system of embodiment 1 includes an impurity concentration measurement unit D that measures an impurity amount (oxygen concentration) in high purity nitrogen, a first flow rate adjustment unit 10 that controls a high purity nitrogen amount, a second flow rate adjustment unit 11 that controls ultrahigh purity nitrogen amount, and a flow rate control unit 12 that controls the second flow rate adjustment unit 11 based on an impurity concentration measurement result measured by the impurity concentration measurement unit D. The first flow rate adjustment unit 10 may or may not be present.

The second flow rate adjustment unit 11 is adjusted by the flow rate control unit 12 as to increase an amount of nitrogen that is extracted from the ultrahigh purity nitrogen extraction pipe 5 when an impurity measurement result (oxygen concentration) is less than a second concentration set in advance, and to decrease an amount of nitrogen that is extracted from the ultrahigh purity nitrogen extraction pipe 6 when the impurity measurement result (oxygen concentration) is the second concentration set in advance or more.

As the impurity concentration measurement unit D, for example, an oxygen content meter (capable of continuous analysis to which an oxygen concentration cell is applied) can be used. Measurement of the Ar concentration in nitrogen is difficult due to resemblance of the chemical and physical properties of nitrogen and Ar. The present inventors found that the Ar content in ultrahigh purity nitrogen and the oxygen content in high purity nitrogen are correlated. Thus, the flow rate control unit 12 obtains the Ar content in the ultrahigh purity nitrogen based on the oxygen content in high purity nitrogen, and controls the second flow rate adjustment unit 11 to adjust the derived amount of ultrahigh purity nitrogen.

EXAMPLE

The inventors calculate the derived amounts of high purity nitrogen (the oxygen concentration is 1 volume ppm) and ultrahigh purity nitrogen (the Ar concentration is 1 volume ppm) according to the change in the position of the intermediate plate, in the conditions of the rectifying unit of the number of theoretical plates of 60 and the material air amount of 1000 $Nm^3/h$ by simulation, and a result thereof is illustrated in FIG. 3. Further, FIG. 3 also illustrates an improvement efficiency in the case of being compared with the conventional art of extracting the same amount ultrahigh purity nitrogen (the Ar concentration is 1 volume ppm) from the rectifying column of the number of theoretical plates of 60, and extracting the same amounts of high purity nitrogen (the oxygen concentration is 1 volume ppm) from different rectifying columns of the numbers of theoretical plates of 49 to 40.

In the present simulation, an intermediate plate is within a range from a position of the theoretical plate number 49 to a position of 40. For example, when the intermediate plate is at the position of the theoretical plate number 44, the derived amount of ultrahigh purity nitrogen is 208 $Nm^3/h$, and the derived amount of high purity nitrogen is 184 $Nm^3/h$.

When ultrahigh purity nitrogen with the Ar concentration of 1 volume ppm is produced by the conventional process of extracting nitrogen from only the upper plate of the rectifying unit in the conditions that the number of theoretical plates is similarly set at 60, and the material air amount is similarly set at 1000 $Nm^3/h$, the derived amount of ultrahigh purity nitrogen is 363 $Nm^3/h$. A ratio of the material air amount and the derived amount of ultrahigh purity nitrogen is fixed, so that 1000:363=[the material air amount for obtaining 208 Nm3/h]:208 is established in the same conditions. That is, in the case of obtaining the ultrahigh purity nitrogen derived amount of 208 $Nm^3/h$, the necessary material air amount is $1000 \times 208 \div 363 = 573$ $Nm^3/h$.

When high purity nitrogen with the oxygen concentration of 1 volume ppm is produced in the conditions that another rectifying unit with the number of theoretical plates set as 44 which is the same as the above described intermediate plate is used, and the material air amount is similarly set at 1000 $Nm^3/h$, the high purity nitrogen production amount is 395 $Nm^3/h$. The ratio of the material air amount and the derived amount of high purity nitrogen is fixed, so that 1000:395=[the material air amount for obtaining 184 $Nm^3/h$]:184 is established in the same conditions. That is, in the case of obtaining the high purity nitrogen derived amount of 184 $Nm^3/h$, the necessary material air amount is $1000 \times 184 \div 395 = 465.8$ $Nm^3/h$.

Accordingly, in order to obtain an ultrahigh purity nitrogen derived amount of 208 $Nm^3/h$ and a high purity nitrogen derived amount of 184 $Nm^3/h$ in the conventional art, material air of 1038.8 $Nm^3/h$ that is a total of 573 $Nm^3/h$ and 465.8 $Nm^3/h$ is necessary.

From the result of 1038.8 $Nm^3/h$, an improvement rate of 3.88% is obtained as compared with the case of the material air amount being 1000 $Nm^3/h$. In this way, from the simulation result, the position of the high purity nitrogen extraction pipe can be determined. Further, based on not only the simulation result, but also a pilot plant, or results of both of the simulation and pilot plant, the high purity nitrogen extraction position (the position of the intermediate plate of the rectifying unit) can be set.

From the result illustrated in FIG. 3, it became obvious that the highest improvement rate was achieved in the condition that high purity nitrogen is derived from the theoretical plate number 44, so that the inventors confirmed superiority over the conventional art in the nitrogen generation amount of the present invention in the condition. The result is illustrated in FIG. 4. In the present embodiment, the entire amount of nitrogen does not have to be refined to ultrahigh purity, so that evaluation can be made by the total recovery amount of nitrogen that can be recovered from the rectifying unit A. According to the present example, a total of 392 $Nm^3/h$ of nitrogen can be recovered with 208 $Nm^3/h$ of ultrahigh purity nitrogen that can be derived from NTP 60 of the single rectifying unit A combined with 184 $Nm^3/h$ of high purity nitrogen that can be derived from the NTP 40 of the rectifying unit A, with respect to 1000 $Nm^3/h$ of the material air. In contrast with this, in comparative examples 1 and 2, the ultrahigh purity nitrogen that can be derived from the rectifying unit of the maximum NTP of 44 of comparative example 1 is 314 $Nm^3/h$ with respect to 1000 $Nm^3/h$ of the material air. Further, the ultrahigh purity nitrogen that can be derived from the rectifying unit of the maximum NTP of 60 in comparative example 2 is 363 $Nm^3/h$. Comparing the total nitrogen recovery amounts, it is found that the present example exhibits an effect of efficiency improvement of total nitrogen recovery amount of (392−314)/314=25% as compared with the case of recovering nitrogen from the rectifying unit of the maximum NTP of 44 of comparative example 1, and an effect of efficiency improvement of the total nitrogen recovery amount of (392−363)/363=8% as compared with the case of recovering nitrogen from the rectifying unit of the maximum NPT of 60 in comparative example 2.

Figure 2:
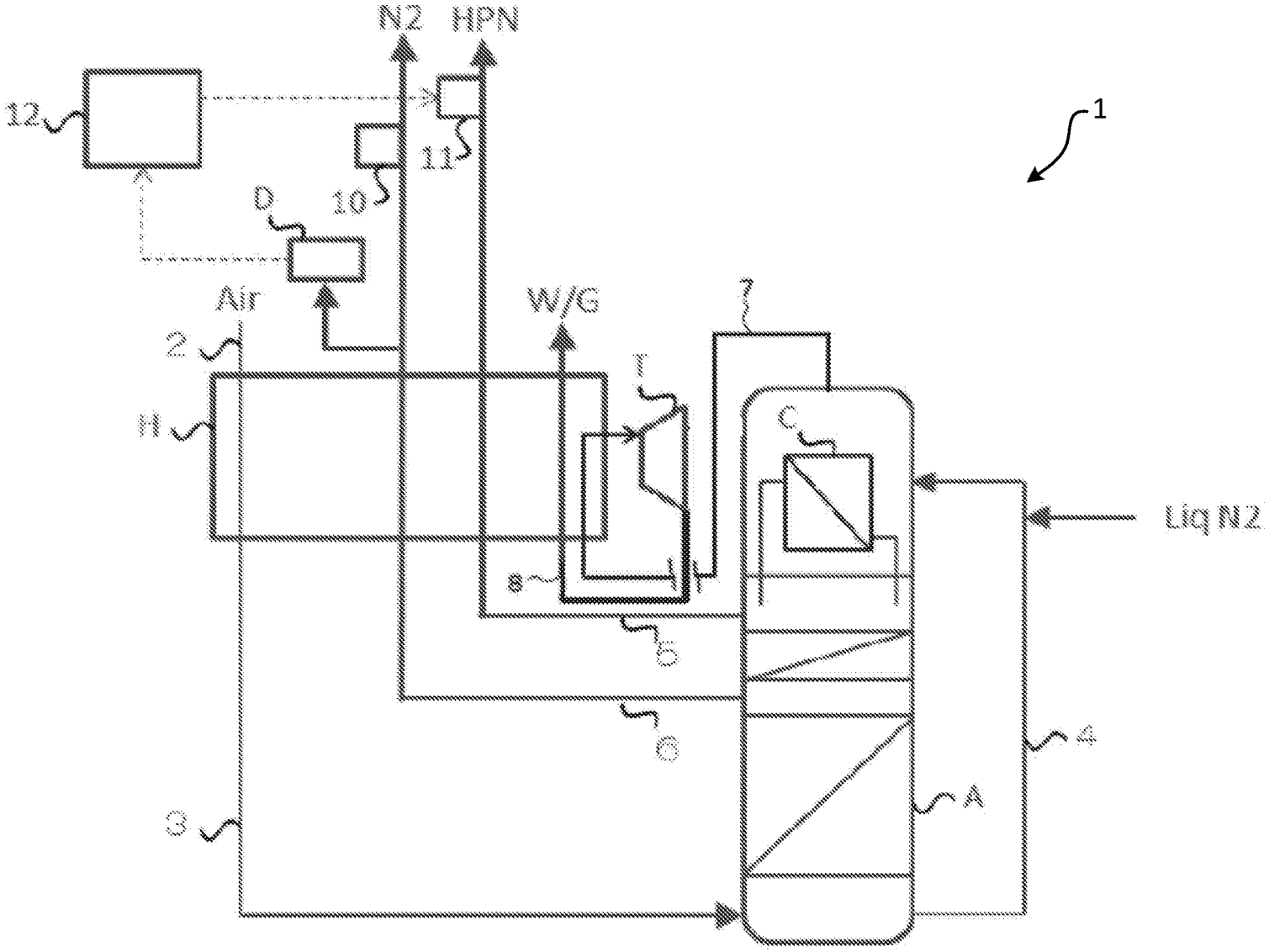
FIG. 2 is a diagram illustrating a configuration example of a nitrogen production system of embodiment 1.

The flow rate control unit 12 can control the derived amount of ultrahigh purity nitrogen by adjusting the second flow rate adjustment unit 11 as illustrated in FIG. 2 when the Ar concentration in the ultrahigh purity nitrogen is set at 1 volume ppm and the oxygen concentration in the high purity nitrogen is set at 1 volume ppm.

When the conditions deviate from the optimum conditions, for example, when the oxygen concentration decreases to less than the second concentration (1 volume ppm), the flow rate control unit 12 adjusts the first flow rate adjustment unit 11 so as to keep the second concentration (1 volume ppm) to control the derived amount of ultrahigh purity nitrogen, as illustrated in FIG. 2. When the oxygen concentration exceeds the second concentration (1 volume ppm), the flow rate control unit 12 adjusts the first flow rate adjustment unit 11 so as to keep the second concentration (1 volume ppm) to control the derived amount of ultrahigh purity nitrogen.

As another embodiment, a configuration can be also adopted, which has a liquid nitrogen introduction pipe for introducing liquid nitrogen to cool the condenser C.

In the case of introducing liquid nitrogen, liquid nitrogen is supplied from a liquid nitrogen supply decrease such as an external liquid nitrogen tank, and cools the condenser C.

In the case of a small nitrogen production system, the condenser can be cooled by only cooling by liquid nitrogen introduction without installing the expensive expansion turbine T. In a facility including the expansion turbine T, the liquid nitrogen introduction pipe does not have to be installed, but the liquid nitrogen introduction pipe can be also installed as backup equipment.

While in the present embodiment, the expansion turbine T that expands waste gas is installed, the present invention is not limited to this, but may adopt a configuration without having the expansion turbine T. In the case like this, a pipe that introduces liquid nitrogen for cooling the condenser C may be provided.

While in the present embodiment, the number of high purity nitrogen extraction pipe 6 is only one, a plurality of high purity nitrogen extraction pipes may be provided in accordance with the kinds of nitrogen to be produced as another embodiment. When the only one high purity nitrogen extraction pipe 6 is used, two kinds of products that are one kind of high purity nitrogen and ultrahigh purity nitrogen are obtained. When two or more of the high purity nitrogen extraction pipes 6 are used (respectively installed in different plate numbers), the high purity nitrogen extraction pipes are provided at heights corresponding to the different theoretical plate numbers. Thereby, three kinds or more products that are two kinds or more high purity nitrogen having different purities in accordance with the mounting positions of the high purity nitrogen extraction pipes 6, and ultrahigh purity nitrogen are obtained.

Embodiment 2

A process of producing nitrogen with different purities of embodiment 2 will be described. The process of embodiment 2 can be favorably executed by using the system of the above described embodiment 1.

A nitrogen production process of processing nitrogen by low temperature distillation includes a compression step of compressing material air;

a removal step of removing predetermined impurities from the material air compressed in the compression step, a cooling step of cooling the material air from which the impurities are removed in the removal step by a heat exchanger, a first introduction step of introducing the material air cooled by the heat exchanger into a lower part from the rectifying unit position of a nitrogen rectifying column including a rectifying unit and a condenser located in a column top, a second introduction step of introducing an oxygen-enriched liquefied gas into the condenser from the lower part from the rectifying unit position of the nitrogen rectifying column, a first derivation step of deriving ultrahigh purity nitrogen containing a first concentration of argon from an upper plate or an uppermost plate of the rectifying unit of the nitrogen rectifying column, and recovering the ultrahigh purity nitrogen through the heat exchanger, and a second derivation step of deriving high purity nitrogen containing a second concentration of oxygen from an intermediate plate of the rectifying unit of the nitrogen rectifying column, and recovering the high purity nitrogen through the heat exchanger.

Further, the above described process includes an oxygen concentration measuring step of measuring an oxygen concentration in the high purity nitrogen downstream of the heat exchanger, and a flow rate control step of controlling a first flow rate adjustment unit that is provided downstream of the heat exchanger and adjusts a flow rate of ultrahigh purity nitrogen, based on the oxygen concentration measured in the oxygen concentration measuring step.

Further, the oxygen concentration measuring step may measure the oxygen concentration in real time, or measure the oxygen concentration in a predetermined timing or in accordance with a measurement rule set in advance.

Further, the flow rate control step may control the first flow rate adjustment unit so that the oxygen concentration keeps a target value (or a predetermined range).

Further, the flow rate control step, for example, may control the first flow rate adjustment unit so as to increase the flow rate of the ultrahigh purity nitrogen when the oxygen concentration decreases below a target value (or a predetermined range), and control the first flow rate adjustment unit so as to decrease the flow rate of the ultrahigh purity nitrogen when the oxygen concentration increases more than the target value (or the predetermined range).

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A nitrogen production system, comprising:

a heat exchanger configured to at least partially condense a compressed and purified air stream to form a cooled air stream;

a nitrogen rectifying column configured to receive the cooled air stream and separate the cooled air stream into an oxygen enriched liquid and a nitrogen enriched top gas, the nitrogen rectifying column having a top portion, a bottom portion and a rectification section located between the top portion and the bottom portion;

a top condenser in fluid communication with the top portion of the nitrogen rectifying column such that the top condenser is configured to receive a nitrogen-enriched top gas and condense the nitrogen-enriched top gas, and then return the condensed nitrogen-enriched top gas to the top portion as reflux, wherein the top condenser is in fluid communication with the bottom portion of the nitrogen rectifying column such that the top condenser is configured to receive an oxygen-enriched liquid from the bottom portion;

a cold ultrahigh purity conduit in fluid communication with the top portion of the nitrogen rectifying column and the heat exchanger, wherein the ultrahigh purity conduit is configured to transfer ultrahigh purity nitrogen from the nitrogen rectifying column to the heat exchanger for warming therein;

a cold high purity conduit in fluid communication with an intermediate section of the rectification section of the nitrogen rectifying column, wherein the high purity conduit is configured to transfer high purity nitrogen from the rectification section of the nitrogen rectifying column to the heat exchanger for warming therein, wherein the high purity nitrogen has an oxygen concentration;

a warm ultrahigh purity conduit in fluid communication with the heat exchanger and configured to remove the ultrahigh purity nitrogen from the heat exchanger after warming therein;

a warm high purity conduit in fluid communication with the heat exchanger and configured to remove the high purity nitrogen from the heat exchanger after warming therein;

an oxygen concentration measurement unit in fluid communication with the warm high purity conduit and configured to measure the oxygen concentration of the high purity nitrogen; and a controller configured to indirectly determine the argon concentration of the ultrahigh purity nitrogen stream using the measured oxygen concentration of the high purity nitrogen, wherein the controller is further configured to adjust a flow rate of the ultrahigh purity nitrogen withdrawn from the nitrogen rectifying column based upon the measured oxygen concentration of the high purity nitrogen.

2. The nitrogen production system according to claim 1, wherein the oxygen concentration measurement unit is configured to measure the oxygen concentration of the high purity nitrogen continuously in real time.

3. The nitrogen production system according to claim 1, wherein the oxygen concentration measurement unit is configured to measure the oxygen concentration of the high purity nitrogen intermittently at pre-determined intervals.

4. The nitrogen production system according to claim 1, wherein the controller is further configured to increase the flow rate of the ultrahigh purity nitrogen when the oxygen concentration of the high purity nitrogen is below a threshold value or range, wherein the controller is further configured to decrease the flow rate of the ultrahigh purity nitrogen when the oxygen concentration of the high purity nitrogen is above the threshold value or range.

5. The nitrogen production system according to claim 1, wherein the controller is further configured to adjust a flow rate of the high purity nitrogen withdrawn from the nitrogen rectifying column based upon the measured oxygen concentration of the high purity nitrogen.

6. The nitrogen production system according to claim 1, wherein the rectification section comprising plates or packing.

7. A nitrogen production process comprising the steps of:

cooling a compressed and purified air stream in a heat exchanger to form a cooled air stream;

introducing the cooled air stream into a nitrogen rectifying column for rectification therein, the nitrogen rectifying column having a top portion, a bottom portion and a rectification section located between the top portion and the bottom portion;

withdrawing an oxygen-enriched liquid from the bottom portion of the nitrogen rectifying column and introducing the oxygen-enriched liquid to a top condenser, wherein the top condenser is in fluid communication with the top portion of the nitrogen rectifying column such that the top condenser is configured to receive a nitrogen-enriched top gas, condense the nitrogen-enriched top gas, and then return the condensed nitrogen-enriched top gas to the top portion as reflux;

withdrawing an ultrahigh purity nitrogen stream from the top portion of the nitrogen rectifying column, warming the ultrahigh purity nitrogen stream in the heat exchanger, and then recovering the ultrahigh purity nitrogen stream from the heat exchanger;

withdrawing a high purity nitrogen stream from the rectification section of the nitrogen rectifying column, warming the high purity nitrogen stream in the heat exchanger, and then recovering the high purity nitrogen stream from the heat exchanger;

measuring the oxygen concentration of the high purity nitrogen;

indirectly determining the argon concentration of the ultrahigh purity nitrogen stream using the measured oxygen concentration; and adjusting a flow rate of the ultrahigh purity nitrogen withdrawn from the nitrogen rectifying column based upon the measured oxygen concentration of the high purity nitrogen if the argon concentration is determined to be outside of a targeted range.

8. The nitrogen production process according to claim 7, further comprising:

measuring the oxygen concentration of the high purity nitrogen; and adjusting a flow rate of the ultrahigh purity nitrogen withdrawn from the nitrogen rectifying column based upon the measured oxygen concentration of the high purity nitrogen.

9. The nitrogen production process according to claim 8, wherein the oxygen concentration of the high purity nitrogen is measured continuously in real time.

10. The nitrogen production process according to claim 8, wherein the oxygen concentration of the high purity nitrogen is measured intermittently at pre-determined intervals.

11. The nitrogen production process according to claim 8, wherein the flow rate of the ultrahigh purity nitrogen is increased when the oxygen concentration of the high purity nitrogen is below a threshold value or range, wherein the flow rate of the ultrahigh purity nitrogen is decreased when the oxygen concentration of the high purity nitrogen is above the threshold value or range.

12. The nitrogen production process according to claim 8, further comprising adjusting a flow rate of the high purity nitrogen withdrawn from the nitrogen rectifying column based upon the measured oxygen concentration of the high purity nitrogen.

13. The nitrogen production process according to claim 7, wherein the rectification section comprising plates or packing.

* * * * *